United States Patent [19]

Schneider

[11] 4,023,366

[45] May 17, 1977

[54] ISOTHERMAL OPEN CYCLE THERMODYNAMIC ENGINE AND METHOD

[75] Inventor: Richard N. Schneider, Reno, Nev.

[73] Assignee: Cryo-Power, Inc., Reno, Nev.

[22] Filed: Sept. 26, 1975

[21] Appl. No.: 616,976

[52] U.S. Cl. ..... 60/671; 60/509

[51] Int. Cl.[2] ..... F01K 25/00

[58] Field of Search ..... 60/644, 655, 651, 670, 60/671, 643, 650, 682, 508, 509, 512

[56] References Cited

UNITED STATES PATENTS

| | | | |
|---|---|---|---|
| 2,514,875 | 7/1950 | Kollsman | 60/682 |
| 3,228,196 | 1/1966 | Paulsen | 60/682 X |
| 3,698,184 | 10/1972 | Barrett | 60/672 |
| 3,867,816 | 2/1975 | Barrett | 60/682 |
| 3,928,974 | 12/1975 | Benson | 60/650 |

*Primary Examiner*—Martin P. Schwadron
*Assistant Examiner*—H. Burks, Sr.
*Attorney, Agent, or Firm*—Warren P. Kujawa

[57] ABSTRACT

A pollution-free thermodynamic engine system and method for converting thermal potential energy to useful mechanical energy employing an isothermal or quasi-isothermal primary working fluid thermodynamic expansion cycle. A relatively cold primary working fluid is conducted from a low temperature storage tank, through a plurality of engine stages each comprising a heat exchanger and an expansion engine operated on an isothermal of quasi-isothermal expansion cycle, and finally exhausted. A relatively warm secondary fluid is circulated through the engine stages to provide a heat input thereto. The engine stages are connected to the primary working fluid path in parallel to operate on a first isothermal expansion cycle; the engine stages are cascaded to operate on a second serial isothermal expansion cycle. A plurality of preliminary heat exchangers in the primary fluid loop enable operation of the engine system on an alternate quasi-isothermal cycle in which the primary working fluid is cycled a plurality of times in a closed loop to improve the energy conversion efficiency of the system.

26 Claims, 11 Drawing Figures

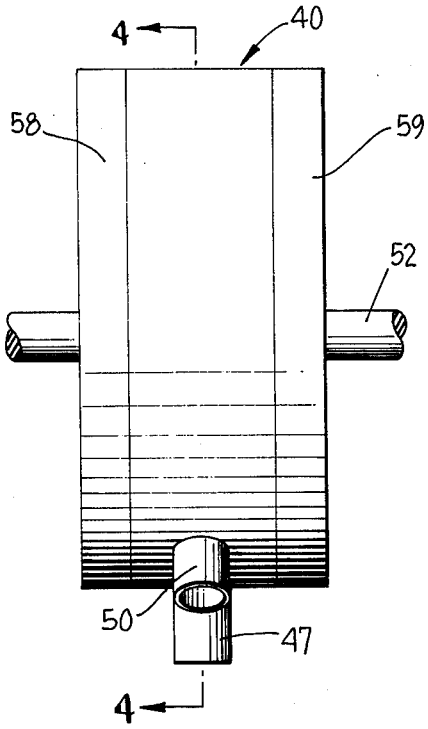
Fig. 3
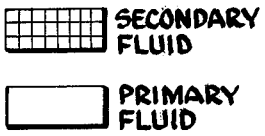
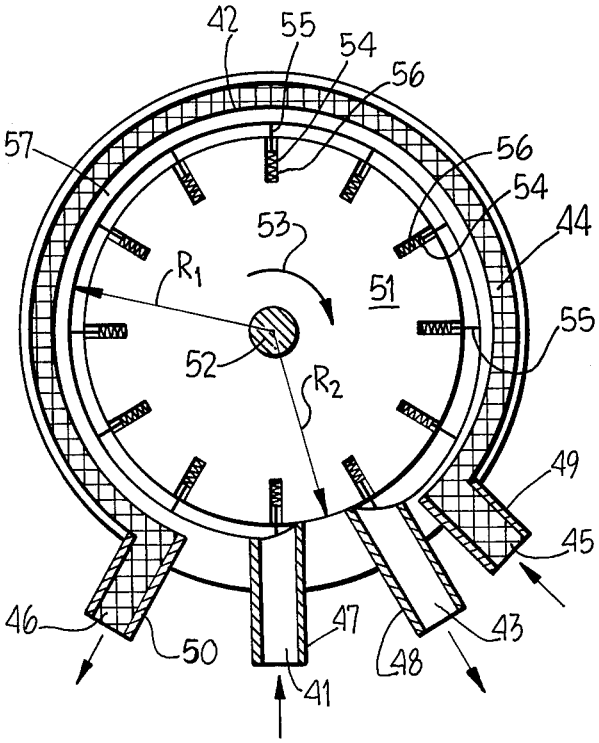
Fig. 4

ISOTHERMAL OPEN CYCLE THERMODYNAMIC ENGINE AND METHOD

BACKGROUND OF THE INVENTION

This invention relates to thermodynamic engine system and methods for generating mechanical power for diverse utilization devices. More particularly, this invention relates to thermodynamic engine systems which utilize the temperature differential between two fluids to provide mechanical energy to follow-on machinery.

Thermodynamic engine systems and methods are known in which mechanical or other forms of energy are obtained from the thermal differential between a primary working fluid and a secondary fluid. In a typical system of this type, such as that disclosed in commonly assigned copending U.S. Pat. No. 3,986,359 for THERMODYNAMIC ENGINE SYSTEM AND METHOD filed May 29, 1973, rotary mechanical power is obtained from the temperature differential between a primary working fluid and the secondary fluid through successive energy conversion stages in each of which the thermal potential energy is converted into rotary mechanical energy. This rotary mechanical energy is then used directly to power a utilization device, such as a pump. Alternatively, the rotary mechanical energy may be converted in a known way to reciprocating mechanical energy for driving suitable follow-on devices.

Each engine stage in such a thermodynamic engine system typically comprises a heat exchanger in which the primary working fluid is heated up approximately ambient temperature by the secondary fluid and an expansion engine in which the heated primary fluid from the outlet of the associated heat exchanger is permitted to expand to produce mechanical energy.

Thermodynamic energy systems of this type are capable of operation with little or no noise pollution and, since the only exhaust product is typically an inert gas such as nitrogen, contribute no chemical pollution to the ambient atmosphere, and are thus highly desirable from an ecological standpoint.

The disclosure of the above-referenced patent application is directed to a system and method in which the primary working fluid operates on a thermodynamic cycle which comprises an initial isentropic compression, followed by successive steps of constant volume heating and isentropic expansion. As noted in the application, the total amount of useful work obtainable with this thermodynamic cycle is substantially greater than that obtainable with prior thermodynamic engines utilizing constant pressure heating cycles, and thus the system and method of the application provides superior performance to known engines using a relatively low temperature fluid as the primary working fluid.

Ideally, even more efficient thermodynamic engines than those employing the thermodynamic cycle of the application supra are theoretically possible. Specifically, for engines using a low temperature fluid as the primary working fluid, the maximum work theoretically obtainable is realized if the working fluid is heated to the temperature of the heat source (typically the secondary fluid or ambient temperature) and then expanded isothermally rather than isentropically or adiabatically. As a practical matter it is not possible, to heat the primary working fluid to exactly ambient temperature and maintain the primary fluid at a temperature which differs from ambient temperature by a nominal amount, typically a few degrees centigrade. Efforts to date, however, to provide operable thermodynamic engines using an isothermal or quasi-isothermal thermodynamic cycle for a low temperature primary working fluid have not met with success.

SUMMARY OF THE INVENTION

The invention comprises a thermodynamic engine system and method employing a thermodynamic working fluid cycle in which a primary low temperature working fluid is expanded isothermally or quasi-isothermally, the system and method being highly efficient, pollution-free if desired and also free of the problem of heat exchanger icing. The invention employs a relatively cold primary working fluid which is conducted in an open loop from a low temperature storage tank to a plurality of engine stages each comprising a heat exchanger and an isothermal expansion engine and ultimately exhausted; and a relatively warm secondary fluid heat source which is thermally coupled to the relatively cold primary working fluid in each engine stage to provide heat input thereto sufficient to sustain an isothermal expansion thereof. For some applications a secondary fluid loop is not required. For example, if the engine duty cycle is such that the thermal heat capacity of the engine provides enough heat for the time of operation; or if the engine is operated under water, etc. The engine stages may be coupled to the primary working fluid loop either in parallel or serial fashion depending on the requirements of a particular application. In one embodiment, a plurality of preliminary heat exchangers are provided in the primary fluid loop between serially coupled adjacent engine stages to cycle the primary working fluid through a plurality of closed loops to improve the efficiency of the system.

In a first embodiment of the engine stage, the heat exchanger and expansion engine are combined as a single unit in a housing having a chamber substantially concentric of a single work shaft, with a heat exchanger portion occuping approximately one-half of the housing geometry and the expansion engine portion occupying the remaining portion of the housing geometry.

In a second embodiment of the engine stage, the expansion engine portion is flanged by a pair of heat exchangers, with all units mounted on a common output shaft.

For a further understanding of the nature and advantages of the invention, reference should be had to the ensuing detailed description taken in conjunction with the accompanying drawings.

DESCRIPTION OF THE DRAWINGS

FIG. 1 is a schematic diagram of the first embodiment of the system of the invention;

FIGS. 3 and4 illustrate a first embodiment of an engine stage;

DESCRIPTION OF THE PREFERRED EMBODIMENTS

Figure 7:
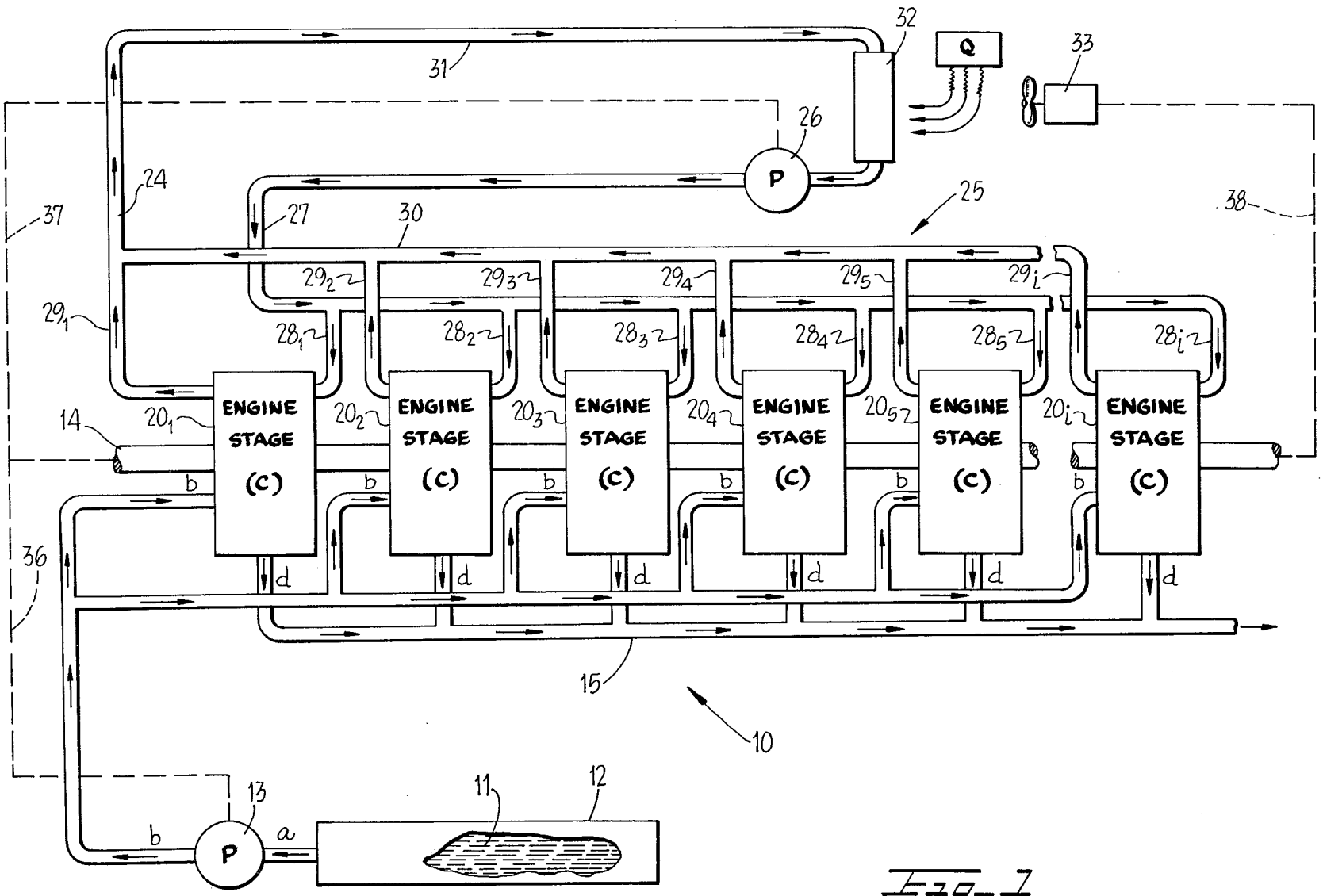
FIGS. 5–7 illustrate an alternate embodiment of an engine stage.

Turning now to the drawings, FIG. 1 illustrates a first embodiment of a thermodynamic engine system in accordance with the invention and having an open primary fluid loop indicated generally at 10 and a closed secondary fluid loop indicated generally at 25. Primary working fluid 11, which in the preferred embodiment comprises liquid nitrogen, is stored at a cryogenic temperature in an insulated tank 12. The primary working fluid 11 is fed from storage tank 12 by means of a feeder pump 13 powdered by a main work shaft 14, described below, to the inlet of a plurality of engine stages $20_1$, $20_2$, . . . $20_i$. Alternatively, primary working fluid 11 may be stored in tank 12 under pressure, in which case pump 13 may be omitted. As described more fully below, each engine stage comprises a heat exchanger and an expansion engine. The primary working fluid 11 is conducted from the individual outlets of engine stages $20_1$-$20_i$ to a common exhaust conduit 15 from which the exhausted primary working fluid is either vented to atmosphere or conducted to some other environment. When used in conjunction with electronic devices in a marine environment, e.g., the exhausted fluid may be used to provide an inert atmosphere for protecting the electronicequipment from sea water. Other suitable arrangements and uses for exhausted primary working fluid 11 will occur to those skilled in the art.

The secondary fluid 24 is circulated through secondary fluid loop 25 by means of a conventional circulation pump 26, a conduit 27, and a plurality of parallel connected inlet conduits $28_1$-$28_i$. After passing through respective engine stages $20_1$-$20_i$, the cooled secondary working fluid 24 is coupled via a plurality of parallel connected outlet conduits $29_1$-$29_i$ and common conduit 30, 31 to a single heat exchanger 32.

Heat exchanger 32 is a conventional unit for injecting heat from a source indicated generally at Q in a secondary working fluid. The heat source may comprise ambient air, a body of water, the earth, hot combustion gases from an associated combustion engine, steam from a conventional boiler or the like, depending on a given application. A suitable circulation means, such as fan 33, may be provided if necessary for directing the heat from source Q to heat exchanger 32. After passing through heat exchanger 32, the secondary fluid 24 is recyled through the secondary fluid loop 25 by pump 26. In some applications, the temperature of the heat source Q may be so low as to render possible icing of secondary heat exchanger 32. Such a possibility might arise, e.g., if heat source Q comprises ambient air at a temperature near or below 32° F. In such applications, icing of the secondary heat exchanger 32 may be prevented by conventional means, such as by injecting a de-icing fluid upstream therefrom or by providing a pair of alternately operated secondary fluid heat exchangers each having a duty cycle of approximately 50%.

Although many fluids, such as common automotive anti-freeze, for example, a mixture of water and Prestone II anti-freeze fluid, or an ethylene glycol-water mixture are suitable for use as the secondary fluid 24, the preferred fluid is ASHRAE, (American Society of Heating, Refrigeration and Air Conditioning Engineers) No. 216 Refrigerant (1,3-Dichlorophexafluoropropane -$C_3 C_2 F_6$). The following refrigerants are also suitable for this purpose.

| ASHRAE NO. | CHEMICAL FORMULA | COMPOUND |
|---|---|---|
| Refrigerant 11 | $C Cl_3 F$ | Trichlorofluoroethane |
| Refrigerant 12 | $C Cl_2 F_2$ | Dichlorodifluoromethane |
| Refrigerant 13 | $C Cl F_3$ | Chlorotrifluoromethane |
| Refrigerant 717 | $NH_3$ | Anhydrous Ammonia |
| Refrigerant 142 b | $CH_3CCl F_2$ | Trichlorofluoromethane |
| Refrigerant 152 a | $CH_3CH F_2$ | Difluoroethane |
| Refrigerant 290 | $CH_3 CH_2CH_3$ | Propane |
| Refrigerant 600 | $CH_3CH_2CH_2CH_3$ | N-Butane |
| Refrigerant 600a | $CH (CH_3)$ | Isobutane |

Other suitable fluids will occur to those skilled in the art.

Figure 2:
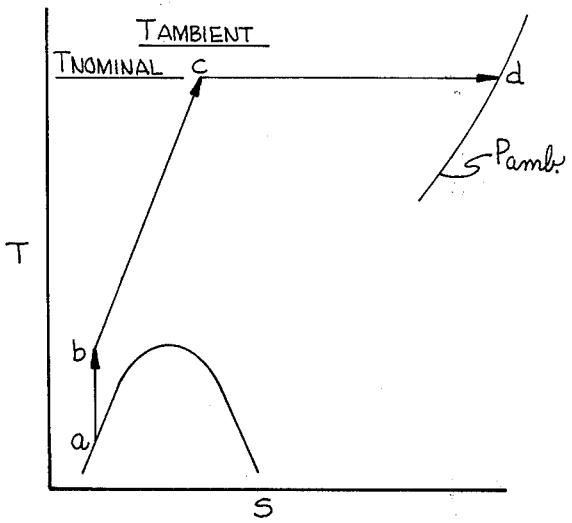
FIG. 2 is a T-S chart illustrating the operation of the system of FIG. 1.

The operation of the system of FIG. 1 may best be understood by referring to FIGS. 1 and 2, the latter FIG. comprising a temperature-entropy, or TS, chart for the primary working fluid 11 of the system of FIG. 1 which illustrates the idealized case in which primary working fluid 11 in each of engine stages $20_1$-$20_i$ is expanded isothermally after an initial heating portion. Assuming mechanical pumping, as the primary working fluid is pumped from source tank 12 to the inlet of each of engine stages $20_1$-$20_i$, it is substantially isentropically compressed from state *a* to state *b*. As primary working fluid 11 passes through the heat exchanger portion of each of engine stages $20_1$-$20_i$, it is heated to a temperature Tnominal (state *c*) which differs from Tambient (the temperature of source *q*) by a nominal amount. The actual value of Tnominal is dependant upon the thermodynamic parameters of the system, such as specific heat capacity of the secondary fluid 24, the thermal transfer efficiency of heat exchangers 32 and the heat exchanger portions of engine stages $20_1$-$20_i$, and the fluid velocity of secondary fluid 24 in loop 25. In practice these parameters are presented to insure a Tnominal, which is as close as possible to Tambient, since the greater the differential between the two temperatures, the less efficient is the system. Typical values are Tnominal-Tambient −15° C (Tambient minus 15° C) After reaching state *c*, the fluid passes through the expansion engine portion of each of engine stages $20_1$-$20_i$ where it is ideally expanded isothermally to state *d*, thereby producing mechanical energy. Upon exiting from the outlet of the several engine stages $20_1$-$20_i$, the primary working fluid at state *d* is either exhausted to ambient or is utilized in the manner noted above.

Mechanical energy is obtained during the isothermal expansion portion of the primary working fluid thermodynamic cycle in the form of rotation of common work shaft 14 schematically depicted in FIG. 1. A portion of this mechanical energy is used to power feeder pump 13 (if employed), secondary fluid circulation pump 26, and fan 33. This may be accomplished by conventional mechanical devices which are accordingly not depicted in detail but simply schematically indicated by broken lines 36-38.

The above isothermal expansion cycle enables highly efficient conversion of the potential energy stored in low temperature primary working fluid 11 to useful mechanical energy. As noted supra, the maximum work theoretically obtainable from an engine using a low temperature primary working fluid is realized by isothermal expansion at a temperature Tnominal close to Tambient. In addition, in engines requiring a low temperature working fluid, primary working fluid 11 is the "fuel" with which such engines must be supplied to operate and which must be purchased. By maximizing the amount of work extracted from the purchased fuel, and by using the ambient as the heat source for the system, the cost of the energy provided by such thermodynamic engine systems is minimized.

FIG. 3 is a front elevational view and FIG. 4 is a sectional view taken along lines 4—4 of FIG. 3 of a first embodiment of an engine stage suitable for use in the thermodynamic engine system of the invention. In this embodiment, each engine stage 20 comprises a single unit incorporating both a heat exchanger portion and an expansion engine portion in a single housing 40. Housing 40 is a substantially cylindrical member having a hollow interior with a first wall surface portion having a constant radius R1 in the region extending clockwise from a primary fluid inlet port 41 to an intermediate angular location designated by reference numeral 42, and a second wall surface portion of increasing radius in the region extending in a clockwise direction from intermediate angular location 42 to a primary fluid outlet port 43. A third wall surface portion in the region between inlet port 41 and outlet port 43 is substantially cylindrical to radius R2 smaller than R1. A secondary fluid passage 44 is formed in central housing 40 and extends between a secondary fluid inlet port 45 and a secondary fluid outlet port 46. Ports 41, 43, 45 and 46 are each provided with suitable fittings 47-50 sealingly secured thereto to facilitate fluid coupling between the engine stage and the external conduits.

A single substantially cylindrical rotor 51 having a radius slightly smaller than R2 is mounted on a common shaft 52 within central housing 40 concentrically with respect to radius R1 for rotation in the clockwise direction indicated by the arrow 53. Rotor 51 is provided with a plurality of radially directed longitudinal extending slogs 54 equiangularly spaced circumferentially thereabout. Each slot 54 is provided with a sliding vane 55 biased radially outwardly by a biasing member 56 such as a spring or the like. In some applications the biasing member 56 may be omitted, and the centrifugal force on vanes 55 resulting from rotation or rotor 51 may be relied upon to bias vanes 55 radially outwardly.

Secondary fluid inlet and outlet fittings 49, 50 communicate with secondary fluid passage 44 formed internally of central housing 40. The wall portion 57 between secondary fluid passage 44 and the interior of central housing 40 defines a thermal transfer region throughwhich heat may be transferred from secondary fluid 24 to primary fluid 11.

A pair of end plates 58, 59 are sealingly secured to central housing 40 to seal the interior thereof. Suitable bearing means (not shown) are provided in end plates 58, 59 to enable low friction rotation of common shaft 52 and rotor 51 secured thereto.

In practice, a plurality of engine stages are mounted in a row as indicated in FIG. 1, with rotors 51 commonly coupled to shaft 52.

In operation, with rotor 51 rotating in the clockwise direction indicated by arrow 53, each vane 55 is swept into the region adjacent primary fluid inlet port 41 and is extended by biasing means 56 until it contacts the inner wall surface of central housing 40. As rotor 51 continues to rotate, each vane 55 sweeps along this inner wall surface in fluid sealing relation therewith. Since the annular volume measured in a clockwise direction from inlet 41 to location 42 defined by the radii R1, R2 is constant, incoming primary working fluid 11 introduced via inlet fitting 47 encounters a constant volume region throughout this annular volume. Secondary fluid 24 passes counterflow to the primary working fluid 11 from the inlet fitting 49 via internal passage 44 to outlet fitting 50. As the two fluids counterflow through the heat exchanger portion of the engine stage, heat is transferred through the wall portion 57 from the secondary fluid to the primary fluid, thus raising the temperature of the latter to Tnominal.

As each vane 55 is swept from location 42 to the region adjacent primary fluid outlet port 43, it is extended by biasing means 56 to maintain a fluid seal with the inner wall portion of expanding radius of central housing 40. Since the annular volume measured in a clockwise direction in this region increases from location 42 to the region of outlet 43, as the primary fluid 11 progresses along this volume, it encounters an expanding volume until the first exhaust port 43 is encountered. The expansion of the primary fluid 11 in this region acts on the surface of extended vanes 55 to provide a net force in the clockwise direction, thereby rotating rotor 51 and output shaft 52. The expanded primary working fluid is exhausted via outlet fitting 48.

In the FIGS. 3 and 4 embodiment, the physical dimensions of the primary and secondary fluid paths, the thickness of the thermal transfer region 57, the contour of the expansion region of the inner wall surface of housing 40 and the flow rate of secondary fluid 24 are all selected to provide constant volume heating of primary working fluid 11 to Tnominal in the heat exchanger portion, and isothermal expansion of primary fluid 11 in the expansion portion of the engine stage. The actual value of these parameters depends on a given application and can best be determined with known techniques.

The embodiment of FIGS. 3 and 4 offers the advantages of reducing the frictional losses relative to a heater and expander separately housed and of requiring only a single output shaft 52, which simplifies the operation of the entire system. In addition, the embodiment is extremely compact and economical to manufacture and assemble and may be preferred where small physical size or ease of assembly is a primary requirement of a given application.

Figure 5:
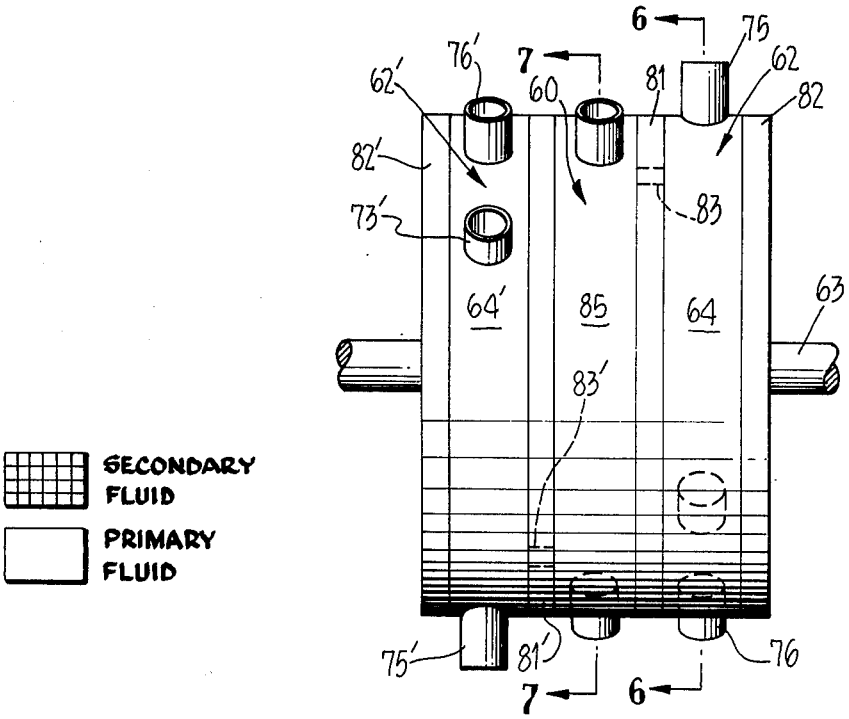
Figure 6:
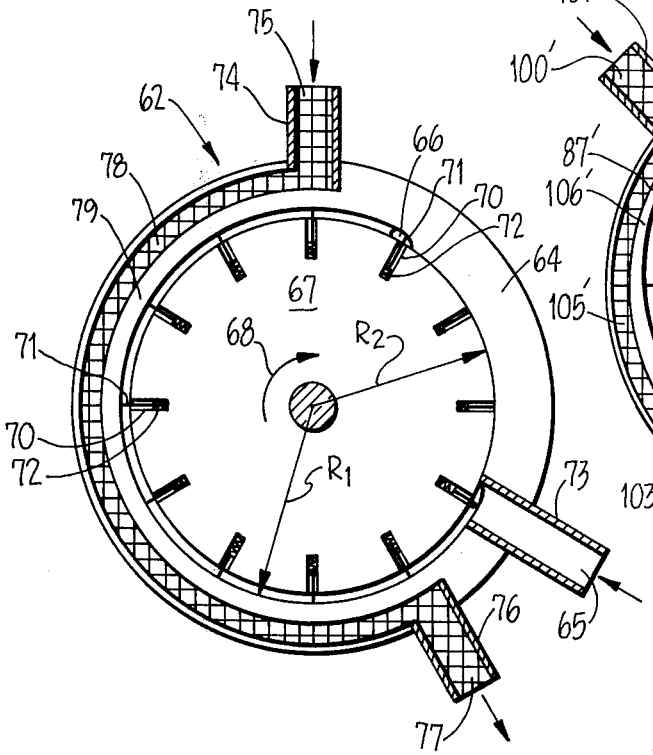
Figure 7:
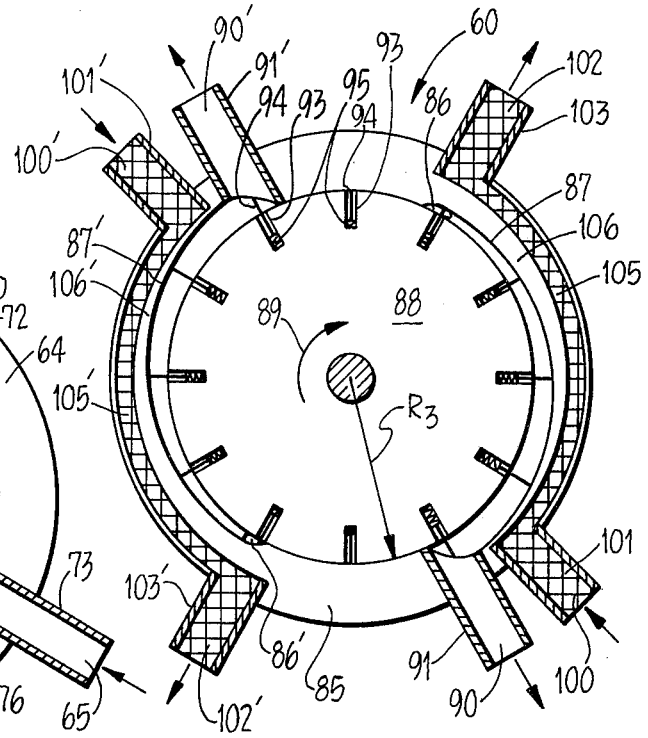

FIG. 5 is a front elevational view and FIGS. 6 and 7 are sectional views taken along lines 6—6 and 7—7, respectively, of FIG. 5 of a second embodiment of an engine stage suitable for use in the thermodynamic engine system of the invention. In this embodiment, each engine stage comprises a central expansion engine portion 60 flanked by a pair of similar heat exchanger portions 62, 62'. Expansion engine portions 60 and heat exchanger portion 62, 62' are mounted on a common shaft 63 with heat exchanger portion 62' angularly displaced from heat exchanger portion 62 by 180°.

As best shown in FIG. 6, which depicts heat exchanger portion 62, a cylindrical central housing 64 has a hollow interior with a first wall surface portion having a radius R1 extending clockwise from a primary fluid inlet port 65 to a primary fluid outlet region 66, and a second smaller arcuate wall surface portion having a constant radius R2 smaller in magnitude than radius R1 extending clockwise from primary fluid outlet region 66 to primary fluid inlet port 65. Positioned within the hollow interior of central housing member 64 is a cylindrical rotor 67, secured to common shaft 63 for rotation in the clockwise direction indicated by arrow 68 and having a cylindrical cross section of radius slightly smaller than R2 in order to provide a close fit between the outer surface thereof and the second smaller arcuate wall surface portion of housing 64.

The circumference of rotor 67 is provided with a plurality of radially directed longitudinally extending slots 70 equiangularly spaced circumferentially thereabout. Each slot 70 is provided with a sliding vane 71 biased radially outwardly by a suitable biasing means 72.

A primary working fluid inlet fitting 73 is sealingly secured in inlet port 65. A secondary fluid inlet fitting 74 is sealingly secured to a second inlet port 75 provided in central housing 64. A secondary fluid outlet 76 is sealingly secured in a secondary fluid outlet port 77 provided in central housing 64 adjacent primary fluid inlet port 65. Secondary fluid inlet and outlet fittings 74, 76 communicate with a secondary fluid passage 78 formed internally of central housing 64. The wall portion 79 between secondary fluid passage 78 and the interior of central housing 64 defines a thermal transfer region through which heat may be transferred from secondary fluid 24 to primary fluid 11.

A pair of end plates 81, 82 are sealingly secured to the end portions of housing 64 to seal the interior thereof. Suitable bearing means (not shown) are provided to permit low friction rotation of common shaft 63 and rotor 67 secured thereto.

As noted above, heat exchanger portion 62' is substantially identical to heat exchanger portion 62. Accordingly, in the ensuing description, the elements of heat exchange portion 62' which correspond to the elements of heat exchange portion 62 are designated by primed reference numerals. As further noted above, heat exhanger 62' is mounted in an angular postion which is rotated 180° from the axial position of heat exchanger 62.

End plates 81, 81' are each provided with a bore 83, shown in FIG. 5 by broken lines respectively, for providing fluid communication for working fluid contained therein from the primary fluid outlet regions 66, 66' to a pair of primary fluid inlet regions in centrally located expansion engine portion 60 described below.

As best shown in FIG. 7, expansion engine portion 60 comprises a cylindrical central hollow housing 85 provided with a pair of primary fluid inlet regions 86, 86' designed to align with fluid bores 83, 83' in end plates 81, 81', respectively. Each inlet region 86, 86' communicates with a different one of a pair of variable volume regions defined by first and second wall surface portions 87, 87' of central housing 85 and the circumference of a substantially cylindrical rotor 88 concentrically mounted within central housing 85 and secured to output shaft 63 for rotation in the clockwise direction indicated by arrow 89. Variable volume regions 87, 87' each terminate at a different outlet port 90, 90' respectively. Central housing 85 is provided with third and fourth wall surface portions between outlet port 90 and inlet region 86', and outlet port 90' and inlet region 86, respectively, of substantially constant radious R3. Expansion engine portion rotor 88 of radius slightly smaller than R3 is provided with a plurality of slots 93, sliding vanes 94, and biasing means 95 in a manner and for a purpose substantially similar to that described above.

Cylindrical housing 85 is further provided with a pair of secondary fluid inlet ports 100, 100' each provided with an inlet fitting 101, 101', respectively, sealingly secured therein. In addition, cylindrical housing 85 is further provided with a pair of secondary fluid outlet ports 102, 102' each having an outlet fitting 103, 103', respectively, sealingly secured thereto. Secondary fluid inlet and outlet fittings 101, 102 communicate with a first secondary fluid passage 105 formed internally of central housing 65. Secondary fluid inlet and outlet fitting 101', 102' communicate with a second secondary fluid passage 105' formed internally of central housing 85. The wall portions 106, 106' between secondary fluid passages 105, 105' respectively, and the interior of central housing 85 define a pair of thermal transfer regions through which heat may be transferred from secondary fluid 24 to primary fluid 11.

In practice, a plurality of engine stages, each comprising an expansion engine portion 60 flanked by a pair of heat exchanger portions 62, 62' are mounted along common shaft 63 with the number of stages depending upon the particular application requirements.

Operation of the embodiment shown in FIGS. 5–7 proceeds in a similar fashion to that described above with reference to FIGS. 3 and 4. Thus, primary working fluid 11 enters heat exchanger portions 62, 62' via inlet fittings 73, 73' and passes through the constant volume by the transfer of heat through wall portions 79, 79' from secondary fluid 24 counterflowing via inlet fittings 74, 74', secondary fluid passages 78, 78' and secondary fluid outlet fittings 76, 76'. Heated primary fluid 11 is coupled from primary fluid outlet regions 66, 66' via outlet bores 83, 83' to inlet regions 86, 86' of the expansion engine porton 60. The heated primary fluid 11 expands along the variable volume regions, thereby rotating rotor 88 and common shaft 63. During the expansion portion of the cycle, primary fluid 11 is maintained at Tnominal by the transfer of heat through wall portions 106, 106' from secondary fluid 24 counterflowing via inlet fittings 101, 101', secondary fluid passages 105, 105' and secondary fluid outlet fittings 103, 103'. The expanded primary working fluid 11 is exhausted via outlet fittings 91, 91'.

Though similar in operation to the embodiment of FIGS. 3 and 4, the embodiment shown in FIGS. 5–7 offers the further advantage of providing a greater capability of transferring heat from the secondary fluid 24 to the primary fluid 11 due to the use of two heat exchanger portions for each expansion engine portion. Moreover, the provision of two variable volume regions in expansion engine portion 60 enables a greater amount of torque to be produced by a single engine stage than the embodiment of FIGS. 3 and 4.

Figure 9:
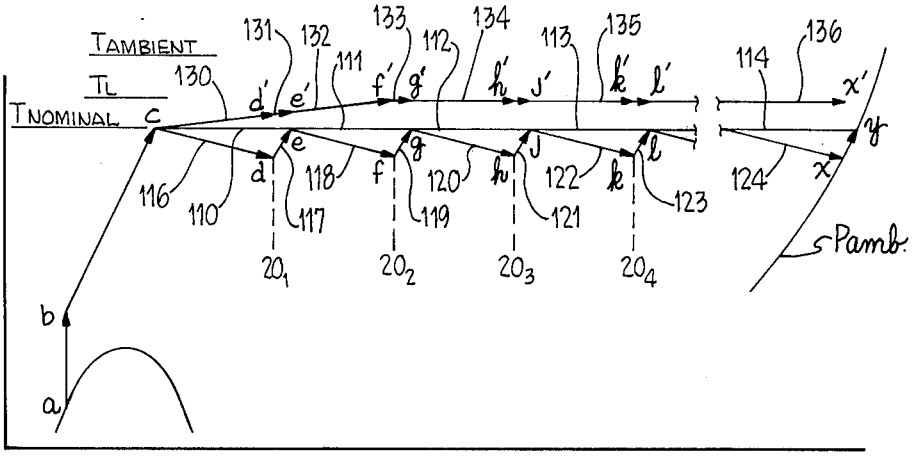
FIG. 9 is a T-S chart illustrating the operation of the system of FIG. 8 over alternate thermodynamic cycles.
Figure 8:
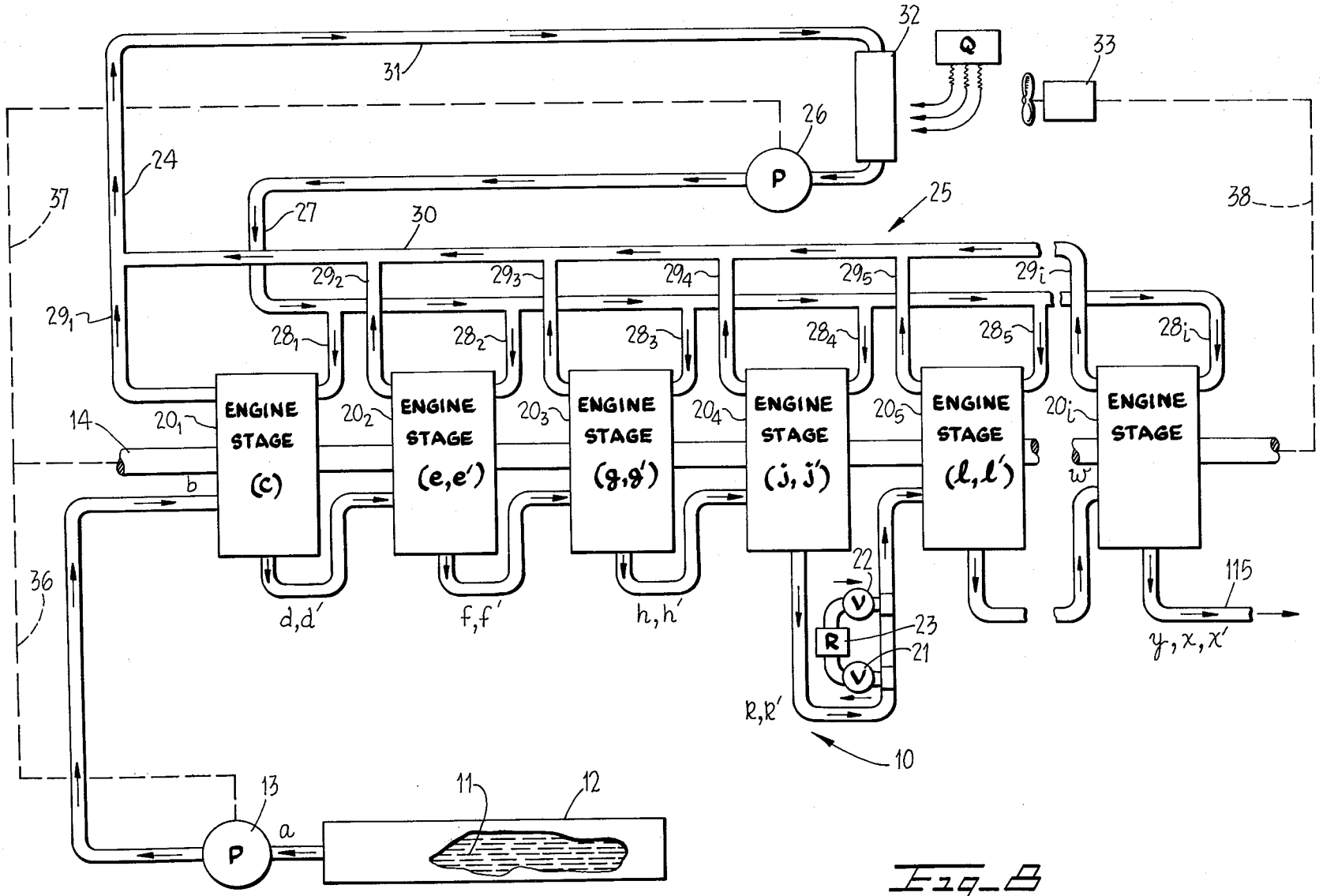
FIG. 8 is a schematic diagram of an alternate embodiment of the system of the invention.

FIG. 8 shows an alternate embodiment of the system of FIG. 1 in which the engine stages $20_1$–$20_i$ are serially coupled to primary working fluid loop 10. The operation of the system of FIG. 8 may best be understood by referring to FIG. 9, which comprises a T-S chart illustrating alternate isothermal and quasiisothermal thermodynamic cycles for primary working fluid 11. The three alternate cycles illustrated in FIG. 9 all share a common introductory cycle portion essentially identical to that described above with reference to FIG. 2. Thus, as primary working fluid 11 is pumped from source tank 12 to the inlet of first engine stage $20_1$, it is substantially isentropically compressed from state *a* to state *b*. As primary working fluid 11 passes through the heat exchanger portion of first engine stage $20_1$, it is heated to Tnominal (state *c*). Thereafter, the primary working fluid 11 is thermodynamically cycled in a different fashion in each of the three cycles depicted.

The first cycle, termed the serial isothermal cycle, is depicted by solid line segments 110–113 and 114. When operated on this cycle, primary working fluid 11 is isothermally expanded in each engine stage $20_1$-$20_i$ and is exhausted to ambient via outlet conduit 115 when the fluid reaches ambient pressure. To operate the system of FIG. 8 according to the serial isothermal cycle, initial engine stage $20_1$ alone provides constant pressure or constant volume heating for primary working fluid 11 to Tnominal, while the remaining engine states $20_2$-$20_i$ provide only isothermal expansion for primary working fluid 11. A system employing engine stages $20_i$ of the type shown in FIGS. 3, 4 or 5–7 may be employed to perform this thermodynamic cycle. Operating primary working fluid 11 over the serial isothermal expansion cycle is preferred to reduce the torque on the individual retractable vanes 55 or 94 of the individual expansion engine portions of the individual engine stages to prevent premature wear or rupture thereof.

The system of FIG. 8 may also be operated in such a manner as to perform the two quasi-isothermal cycles represented by solid line segments 116–125 and broken line segments 130–136, respectively. These two quasi-isothermal expansion cycles represent the condition in which all expansion cycles are not precisely isothermal but proceed in such a manner that, in the case of the first quasi-isothermal cycle, primary working fluid 11 gains insufficient heat from the secondary fluid 24 to maintain isothermal conditions during each expansion, and in the case of the second quasi-isothermal cycle primary working fluid 11 gains sufficient heat from the secondary fluid 24 to increase the working fluid 11 temperature during expansion with a limiting temperature $T_L$ lying between Tambient the Tnominal is reached. Both cycles correspond to the case in which the relative flow parameters of primary working fluid 11 and secondary fluid 24, and the thermal gradient through the thermal transfer region therebetween in the expansion engine portion of the respective engine stages are such that expansion of primary working fluid 11 does not occur isothermally.

With reference to the first quasi-isothermal cycle, along section 116 of the first expansion portion of the cycle, insufficient heat is transferred from the secondary fluid 24 to the primary working fluid 11 to maintain constant temperature during expansion, progressing from state *c* to state *d*. However, when primary working fluid 11 enters the heat exchanger (constant pressure or constant volume) portion of the succeeding engine stage $20_2$, heat is transferred from secondary fluid 24 thereto to raise the temperature to Tnominal before the subsequent expansion thereof. After expansion of the primary working fluid 11, the temperature thereof again drops below TNOMINAL; however, the temperature of primary working fluid 11 is again raised to T NOMINAL in the heat exchanger portion of subsequent engine stage $20_3$. Further cycling of primary working fluid 11 in subsequent engine stages proceeds in the manner described until primary working fluid 11 exits from the last engine stage $20_i$ at state *x*.

The second quasi-isothermal cycle corresponds to the cycling condition in which the flow of secondary fluid 24 through the secondary fluid path in the expansion engine portion of the various engine stages $20_1$-$20_i$ and the thermal gradient in the walls between the primary working fluid and the secondary fluid paths is sufficient to increase the primary working fluid 11 temperature during the expansion of this fluid. The result as indicated by line segments 130 and 131 is that the primary working fluid rises above nominal temperature during successive expansions (*C* to *d'*, *e* to *f'*) as well as during passage of fluid 11 through the constant pressure or constant volume heat exchanger portion of the succeeding engine stages $20_i$. As a result after a number of heating and expansion portions of the cycle (illustrated for two such portions), fluid 11 attains a limiting temperature $T_L$ between T NOMINAL and T AMBIENT (point *g'*), and is thereafter expanded isothermally until the fluid 11 is exhausted at *x'*.

Figure 11:
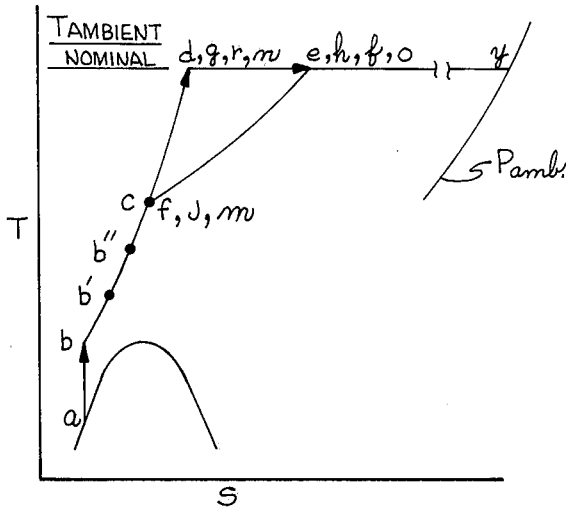
FIG. 11 is a T-S chart illustrating the operation of the system of FIG. 10.
Figure 10:
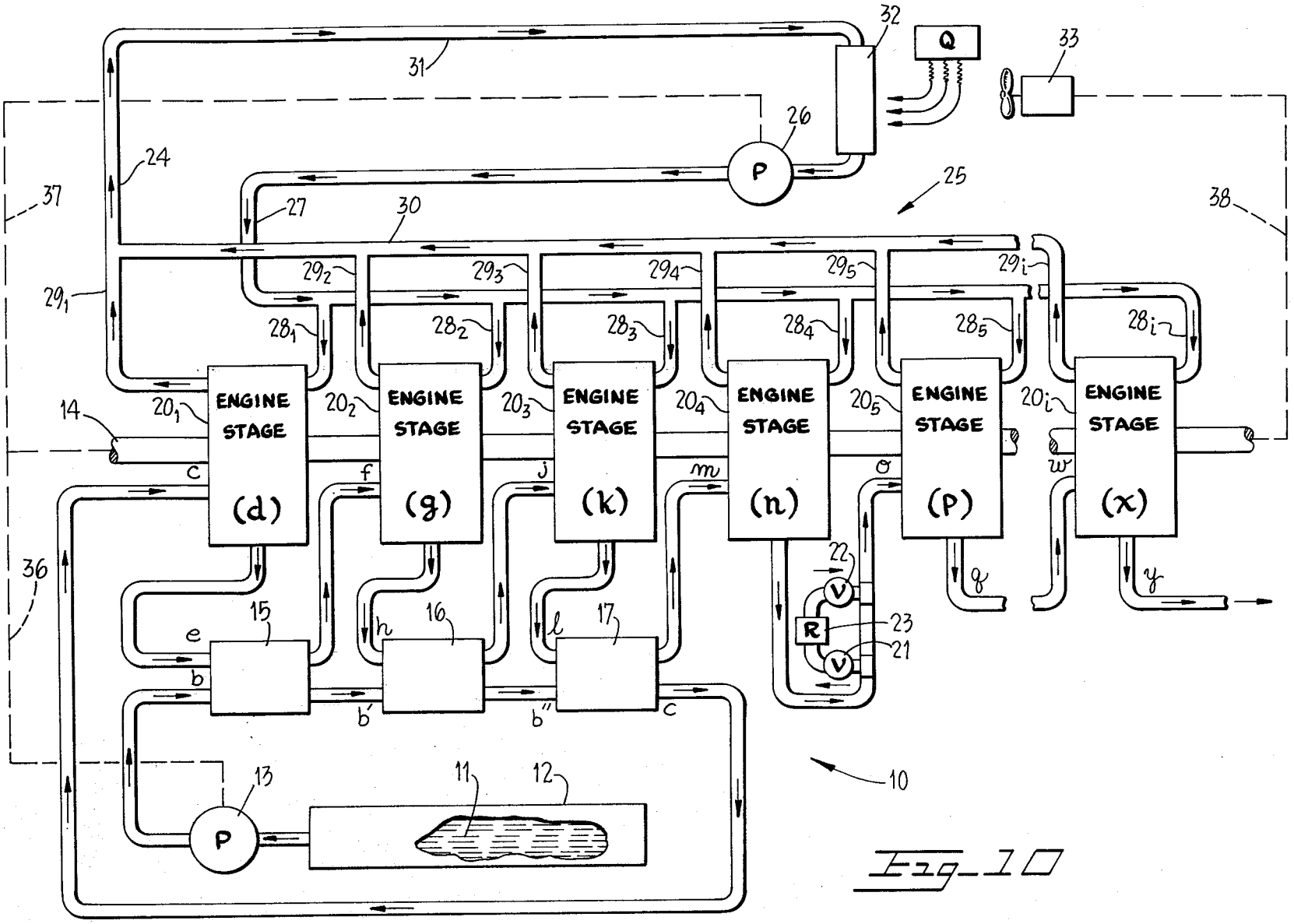
FIG. 10 is a schematic of another embodiment of the system of the invention.

FIG. 10 shows another embodiment of the invention, which includes internal regeneration, especially adapted for cycling primary working fluid 11 in accordance with the thermodynamic cycle depicted in FIG. 11. This embodiment increases the work output of the engine over those disclosed earlier in this application. In this embodiment, a plurality of conventional constant pressure heat exchangers 15–17 are provided which are coupled to the primary working fluid loop 10 and also between the outlet and inlet of successive engine stages $20_1$, $20_2$, $20_3$ for a purpose to be described.

With reference to FIGS 10 and 11, as primary working fluid 11 is pumped from source tank 12 to the inlet of constant pressure heat exchanger 15, it is substantially isentropically compressed to state *b*. As the primary working fluid 11 passes through constant pressure heat exchangers 15–17 it is isobarically heated from state *b* to state *c* by the fluid expelled from the first three engine stages $20_1$-$20_3$ downstream therefrom. Primary working fluid 11 is next passed through the constant volume heat exchanger portion of engine stage 20 wherein it is heated at constant volume to state *d*. After reaching state *d*, the fluid passes through the expansion engine portion of stage $20_1$ where it is isothermally expanded to state *e*, thereby producing mechanical energy. After expansion, the primary fluid passes through constant pressure heat exchanger 15 wherein it is isobarcially cooled from state *e* to state *f*. Upon entering second engine stage $20_2$, the primary fluid is first heated at constant volume from state *f* to state *g* and subsequently isothermally expanded to state *h*. From the outlet of second engine stage $20_2$, the primary fluid is isobarically cooled from state *h* to state *j* in constant pressure heat exchanger 16. The primary fluid is then passed through engine stage $20_3$ where it is first heated at constant volume from state *j* to state *k* and subsequently isothermally expanded to state *l*. The primary fluid is next isobarically cooled from state *l* to state *m* in heat exchanger 17. The primary fluid is next passed through engine stages $20_4$ wherein it is heated at constant volume from state *m* to state *n* and subsequently isothermally expanded to state *o*. Thereafter, primary fluid 11 is serially passed through the remaining engine stages in each of which the fluid is isothermally expanded, the fluid existing via outlet conduit 115 at ambient temperature and pressure (state *y*).

The cycle of FIG. 11, due to the closed loop cycling made possible by heat exchangers 15–17, enables a greater amount of mechanical energy to be produced by the engine system of FIG. 10 from a given quantity of stored primary working fluid and thus may be preferred for applications in which a maximum amount of energy must be produced by the system. Such applications include, for example, use of the system at a remote site in which refueling of tank 12 can only be accomplished with great difficulty, or in areas where the cost of primary working fluid 11 is relatively high. In addition, the engine system of FIG. 10 may be provided with additional heat exchangers between follow-on stages $20_4$, $20_5$, etc. to improve the efficiency of the thermodynamic cycle.

In the system of FIG. 10, an automatic starting device is included between engine stages $20_4$ and $20_5$. The automatic starting device has an inlet valve 21 and an outlet valve 22 (which for some applications may be one and the same valve) each coupled at one end to primary fluid loop 10 and at the other to a fluid reservoir 23. Fluid reservoir 23 stores primary working fluid 11 under pressure via inlet valve 21 when the engine system is operating and releases the stored primary fluid in response to the actuation of outlet valve 22 to provide an initial starting surge when it is desired to start the engine system. Valves 21, 22 may comprise any one of a number of known valve devices, depending on the particular requirements of a given application. For example, if the invention is used as a remotely located power generator, valve 21 may be an inlet check valve which opens after the primary working fluid 11 at the inlet thereto attains a predetermined pressure, while valve 22 may be a normally closed automatic valve responsive to the generation of a control signal from a distant control station to open and couple the previously stored pressurized fluid in reservoir 23 to the inlet of succeeding engine stage $20_5$.

Although depicted as coupled between engine stages $20_4$ and $20_5$, it is understood that the automatic starting device may be coupled to primary fluid 10 at any convenient portion thereof. Further, other engine starter devices may be employed as desired. for example, a battery driven electrical motor may be coupled to main work shaft 14 by appropriate known coupling means for starting purposes in applications where electrical power is available when the system is not operating. In addition, the systems depicted in FIGS. 1 and 8 may likewise be provided with engine starting devices of this type. Other arrangements will occur to those skilled in the art.

Systems constructed according to the invention may be used in a wide variety of applications and are particularly well-suited for use in providing power in remote locations, e.g. in water born sonobuoys, meterological monitoring stations, weather radar stations, remote cloud seeding stations and microwave repeater stations. In addition, since no volatile fuels or hot exhaust gases are present the invention is ideally suited for applications in which noise or chemical pollution cannot be tolerated or where explosion or fire hazards exists. Moreover, the invention can be operated over a wide range of environmental temperatures without significant adverse effects on the efficiency of the system. Further, since the invention requires an extremely short period of the order of less than three seconds with which to come up to full operating power, systems constructed according thereto are ideally suited for use where standby power is required quickly, e.g. in hospital operating rooms, computer centers, portable pneumatic power tools, and the like.

It should be noted that, although specically disclosed with closed secondary fluid loop 25, in many applications an open secondary fluid loop may be employed. For example, an engine system operating in an underwater environment may utilize the surrounding body of water as the secondary fluid or heat source. In such an application, for continuous operation pump 26 can be utilized to pump water along the secondary fluid path portions of the engine stages $20_i$, and the cooled secondary fluid is exhausted to the body of water.

In still other applications it may be possible to dispense entirely with a secondary fluid path and transfer heat relatively warm secondary fluid source, such as sea water. For example, in an application requiring an engine to be run in a non-continuous mode with short on or engine running periods, the isothermal and quasi-isothermal cycles disclosed supra may be employed with beneficial results. The major design criterion in such an application is to ensure a thermal transfer efficiency between the secondary fluid and primary working fluid over the maximum operating cycle which is sufficiently great to provide isothermal expansion of the primary working fluid.

While the foregoing provides a full disclosure of the preferred embodiments of the invention, it is understood that various modifications, alternate constructions and equivalents may be employed without departing from the true spirit and scope of the invention. For example, while the engine stages $20_i$ have been described as having constant volume heat exchanger portions, it is understood that engine stages may be designed employing constant pressure heat exchangers with suitable results. Therefore, the above description and illustrations could not be construed as limiting the scope of the invention which is defined by the appended claims.

What is claimed is:

1. A thermodynamic engine system for providing mechanical energy from thermal potential energy comprising:

a primary working fluid path adapted to be coupled to a source of primary working fluid stored at a relatively cold temperature;

a secondary fluid path adapted to be coupled to a source of secondary fluid stored at a second higher temperature; and at least one engine stage comprising a heat exchanger for transferring heat from said secondary fluid to said primary working fluid, said heat exchanger having a primary working fluid inlet coupled to said primary working fluid path, a primary fluid outlet, and a secondary fluid inlet coupled to said secondary fluid path; and an expansion engine coupled to said primary working fluid outlet of said heat exchanger for generating mechanical energy from heated primary working fluid coupled thereto, said engine including means for substantially isothermally expanding said primary working fluid coupled thereto.

2. The system of claim 1 wherein said primary working fluid path is an open path and said secondary fluid path is a closed path for containing said secondary working fluid.

3. The system of claim 1 wherein said primary working fluid path includes means for pumping said primary working fluid from the inlet of said primary working fluid path to said at least one engine stage.

4. The system of claim 3 wherein said pumping means is powered by said engine stage.

5. The system of claim 1 wherein said heat exchanger is a constant volume heat exchanger.

6. The system of claim 1 wherein said expanding means includes a thermal transfer region for thermally coupling said primary working fluid to said secondary fluid as said primary working fluid passes through said engine to maintain the temperature of said primary fluid substantially constant during expansion thereof.

7. The system of claim 6 wherein said expanding means further includes means defining a secondary fluid channel for enabling said secondary fluid to flow along a boundary of said thermal transfer region.

8. The system of claim 1 including a plurality of said at least one engine stage each having a primary fluid inlet coupled in parallel to said working fluid path and a primary fluid outlet coupled in parallel to an outlet conduit.

9. The system of claim 1 including a plurality of cascaded engine stages, each having a primary fluid inlet and a primary fluid outlet serially coupled to said primary working fluid path.

10. The system of claim 9 further including a plurality of additional heat exchangers each having a first fluid inlet and outlet serially coupled to the primary fluid outlet and inlet, respectively, of adjoining engine stages, and a second fluid inlet and outlet serially coupled to said primary working fluid path upstream of the first one of said plurality of engine stages.

11. An engine stage for use in a thermodynamic engine system, said engine stage comprising:

a heat exchanger adapted to be coupled to a relatively cold primary working fluid and a relatively warm secondary fluid for transferring heat from said secondary fluid to said primary working fluid as the latter flows through said heat exchanger, said heat exchanger having first and second inlets adapted to be coupled to said primary working fluid and said secondary fluid, respectively, and a primary working fluid outlet; and an expansion engine for converting heated primary working fluid to mechanical energy, said expansion engine having an inlet portion coupled to said primary working fluid outlet of said heat exchanger, a primary working fluid outlet, a secondary fluid inlet, a secondary fluid outlet and means for substantially isothermally expanding primary working fluid coupled thereto.

12. The apparatus of claim 11 wherein said expanding means includes a thermal transfer region for thermally coupling said primary working fluid to said secondary fluid as said primary working fluid passes therethrough.

13. The apparatus of claim 12 wherein said expanding means further includes means defining a secondary fluid path to enable said secondary fluid to flow along a boundary of said thermal transfer region.

14. The apparatus of claim 11 wherein said heat exchanger comprises a constant volume heat exchanger.

15. The apparatus of claim 11 wherein said engine stage includes a single housing providing an enclosed chamber, said chamber having a first wall surface portion, with a substantially constant radius $R_1$ in the region along the direction of primary fluid flow from said primary working fluid inlet to an intermediate location, said chamber having a second wall surface portion with an increasing radius of curvature in the region along said direction of fluid flow from said intermediate location to said primary working fluid outlet, and a third wall surface portion with a substantially constant radius of curvature $R_2$ of magnitude less than $R_1$ in the region between said primary fluid outlet and said primary fluid inlet;

a substantially cylindrical rotor rotatably mounted in said chamber having a plurality of radially outwardly biased members for defining constant volume segments in concert with said first wall surface portion and the surface of said rotor and variable volume segments with increasing magnitude with said second wall surface portion and the surface of said rotor;

said housing having a secondary fluid outlet port; and means coupled to said secondary fluid inlet port and said secondary fluid outlet port defining a secondary fluid flow path through the interior of said housing exteriorly of said first and second wall surface portions, the region of said housing between said first wall surface portion and said secondary fluid flow path defining a first thermal transfer region, the portion of said housing between said second wall surface portion and said secondary fluid path defining a second thermal transfer region.

16. The apparatus of claim 11 wherein said expansion engine comprises a housing providing an enclosed chamber, said chamber having a first wall surface portion with an increasing radius of curvature in the region along the direction of fluid flow between said primary fluid inlet and said primary fluid outlet and a second wall surface portion with a substantially constant radius of curvature $R_2$ in the region between said primary fluid outlet and said primary fluid inlet;

a substantially cylindrical rotor rotatably mounted in said chamber having a plurality of radially outwardly biased members for defining volume segments in concert with said first wall surface portion and the outer surface of said rotor, said volume segments increasing in magnitude along said first wall portion in said direction of fluid flow, said rotor having a radius of curvature of the order $R_2$; and means coupled to said secondary fluid inlet and said secondary fluid outlet defining a secondary fluid path in said housing exterior of said first wall surface portion, the region between said first wall surface portion and said secondary fluid path defining a thermal transfer region for thermally coupling primary working fluid to said secondary fluid as said primary fluid flows along said direction.

17. The apparatus of claim 16 further including a second primary fluid inlet and outlet, said chamber having a second wall surface portion with an increasing radius of curvature in the region along the direction of fluid flow between said second primary fluid inlet and said second primary fluid outlet, and a second wall surface portion with a substantially constant radius of curvature $R_2$ in the region between said second primary fluid outlet and said first primary fluid inlet;

an additional secondary fluid inlet and outlet; and means coupled to said additional secondary fluid inlet and outlet defining an additional secondary fluid path within said housing exterior of said chamber, the region of said housing between said second wall surface portion and said additional secondary path defining an additional thermal transfer region for thermally coupling said primary working fluid to said secondary fluid as said primary working fluid flows along said direction.

18. The apparatus of claim 17 wherein said heat exchanger comprises a constant volume heat exchanger for transferring heat from said secondary fluid to said primary working fluid while maintaining the volume of said primary working fluid substantially constant, said heat exchanger having a secondary fluid outlet and including a housing providing an enclosed chamber, said chamber having a wall surface portion with a substantially constant radius of curvature in the region along the direction of primary working fluid flow between said primary working fluid inlet and said primary working fluid outlet of said heat exchanger, said housing having means coupled to said secondary fluid inlet and said secondary fluid outlet defining a secondary fluid flow path through the interior of said housing exterior of said wall surface portion, the region between said secondary fluid passage and said wall surface portion defining a thermal transfer region; and a substantially cylindrical rotor rotatably mounted in said chamber having a plurality of radially outward biased members for defining constant volume segments in concert with said wall surface portion and the outer surface portion of said rotor.

19. The apparatus of claim 18 including an additional constant volume heat exchanger for transferring heat from said secondary fluid to said primary working fluid while maintaining the volume of said primary working fluid substantially constant, said additional heat exchanger having first and second inlets and outlets adapted to be coupled to said primary working and secondary fluids, respectively, said additional heat exchanger comprising a housing providing an enclosed chamber, said chamber having a wall surface portion with a substantially constant radius of curvature in the region along the direction of primary fluid flow between said primary fluid inlet and said primary fluid outlet, said housing having means coupled to said housing means coupled to said secondary fluid inlet and said secondary fluid outlet defining a secondary fluid flow path through the interior of said housing exterior of said wall surface portion, the region between said secondary fluid passage and said wall surface passage defining a thermal transfer region; and a substantailly cylindrical rotor rotatably mounted in said chamber having a plurality of radially outwardly biased members for defining constant volume segments in concert with said wall surface portion and the outer surface of said rotor;

said engine stage further including a common work shaft;

said heat exchangers and said expansion engine being coupled to said common work shaft with said heat exchangers flanking said expansion engine.

20. A method of providing mechanical energy from thermal potential energy comprising:

a. Transferring thermal energy from a relatively warm source to a portion of a quantity of relatively cold primary working fluid by (i) conducting said primary working fluid through a constant volume region; and (ii) conducting said relatively warm source along the boundary of a thermal transfer region in thermal contact with said primary working fluid; and b. Converting the thermal energy transferred to said primary working fluid to mechanical energy by substantially isothermally expanding said primary working fluid.

21. A method of claim 20 wherein said step (b) of converting includes the step of conducting said relatively warm source along a second thermal transfer region in thermal contact with said primary working fluid during expansion thereof.

22. The method of claim 20 including a plurality of steps of expanding said primary working fluid.

23. The method of claim 22 wherein said plurality of expansion steps are performed in parallel.

24. The method of claim 22 wherein said plurality of expansion steps are performed serially.

25. The method of claim 20 further including the steps of:

c. isobarically cooling said primary working fluid after said step (b) of expanding; and d. sequentially performing said steps (a), (b) and (c).

26. The method of claim 24 further including the steps of isobarically cooling said expanded fluid and performing a subsequent step (a) of transferring.

* * * * *